United States Patent [19]

Prato

[11] Patent Number: 4,510,882

[45] Date of Patent: Apr. 16, 1985

[54] COATING APPARATUS AND METHOD FOR THE CURTAIN COATING OF LIQUID COMPOSITIONS USING IT

[75] Inventor: Pietro Prato, Carcare, Italy

[73] Assignee: Minnesota Mining and Manufacturing Company, St. Paul, Minn.

[21] Appl. No.: 538,227

[22] Filed: Oct. 3, 1983

[30] Foreign Application Priority Data

Oct. 6, 1982 [IT] Italy ..... 65212 A/82

[51] Int. Cl.[3] ..... B05C 5/00

[52] U.S. Cl. ..... 118/300; 427/420; 118/DIG. 4

[58] Field of Search ..... 427/420; 118/300, DIG. 4

[56] References Cited

U.S. PATENT DOCUMENTS

| | | | |
|---|---|---|---|
| 3,508,947 | 4/1970 | Hughes | 117/34 |
| 3,632,374 | 1/1972 | Greiller | 117/34 |
| 3,973,062 | 8/1976 | Fahrni | 427/420 |
| 4,041,897 | 8/1977 | Ade | 118/300 |
| 4,109,611 | 8/1978 | Fahrni et al. | 118/DIG. 4 |

FOREIGN PATENT DOCUMENTS

| | | | |
|---|---|---|---|
| 585066 | 12/1977 | U.S.S.R. | 427/367 A |

*Primary Examiner*—Shrive P. Beck

*Attorney, Agent, or Firm*—Donald M. Sell; James A. Smith; Mark A. Litman

[57] ABSTRACT

A coating apparatus including a lip body for the leaving therefrom of the coating composition forms a very stable and uniform curtain if such lip body determines a negative (front) slide surface associated with a back negative surface.

7 Claims, 3 Drawing Figures

COATING APPARATUS AND METHOD FOR THE CURTAIN COATING OF LIQUID COMPOSITIONS USING IT

FIELD OF THE INVENTION

The present invention relates to the curtain coating of liquid compositions on a moving sheet material and to the coating apparatus particularly useful to obtain, with such coating method, coated films of high quality, particularly in the field of photography.

BACKGROUND OF THE ART

It is known to use the curtain coating method in the application of thin layers of liquid compositions to moving sheet materials. The conditions to be respected using such a method have been described by R. D. Brown in Journal Of Fluid Mechanics, 10, 1961 (297–305). Although Brown's teachings are known to the skilled in the art, they can be summarized as follows:

i. For a moderate length curtain such as that employed industrially, the value of Qu (wherein Q is the flow per length unit, u is the curtain velocity and T is the surface tension) should be higher than 2T near the line of impingement of the curtain with the moving surface, since otherwise the disturbance of the flow at the point of impingement will break the curtain.

ii. The curtain should be protected from air currents carried along with the moving surface.

iii. The impingement velocity of the curtain should be above a certain value (of the order of 130 cm/sec.) which is apparently independent of the speed of the surface.

iv. A thin curtain of liquid produced by pumping the liquid through a slot suffers from inherent instability near the slot unless the velocity of the curtain everywhere outside the slot is greater than 2T/Q.

Photographic coating compositions were found to have physical characteristics good for the application of curtain coating. The possibility of using the multiple layer technique, known in the field of bead coating, was also confirmed, as described in U.S. Pat. Nos. 3,615,572 and 3,508,947 (incorporated herein by reference).

Certain coating techniques appeared to be of potential significance to manufacturing processes involving the coating of thin layers by offering the possibility of coating at speeds higher than those normally known or practiced in the art.

Some inherent characteristics of the bead coating method, in fact, made the expert evaluate the maximum speed obtainable with this technique as lower than that obtainable with curtain coating and the quality associated with curtain coating to be better than that obtainable with the bead technique.

Improvements on coating alleys capable of drying photographic film or paper materials coated at high speed were made in view of the indicated possibility of coating at speeds higher than normal in the art and studies were made to optimize the coating method to afford high-quality coating results.

In spite of many efforts spent to study and develop curtain coating, there were still quality problems connected therewith because of non-uniform formation of the curtain while leaving the coating apparatus (or hopper).

Various types of hoppers were designed and built-up to improve the quality characteristics of the coated layers. Normally, a hopper includes (1) one or more feeding bodies which cause the liquid composition to pass through one or more slots and (2) slide surfaces for the sliding of the coating composition until it leaves the apparatus to form the curtain. The end portion of the slide body (3) is normally called the lip (see particularly RD 14715, page 19 wherein various types of lips were described).

SUMMARY OF THE INVENTION

The lip of the hopper for use with curtain coating has been formed to allow good-quality coatings to be obtained when its negative slide (or front) surface is associated with a non-slide (or back) negative surface of the lip body itself. A slide surface in the practice of the present invention refers to the surface along which the coating composition slides in passing from the slot to the space between the lip and the surface to be coated. A non-slide surface refers to that surface of the lip which does not support and transport the coating composition as it passes from a slot and leaves the apparatus to form the curtain.

DETAILED DESCRIPTION OF THE INVENTION

Figure 1:
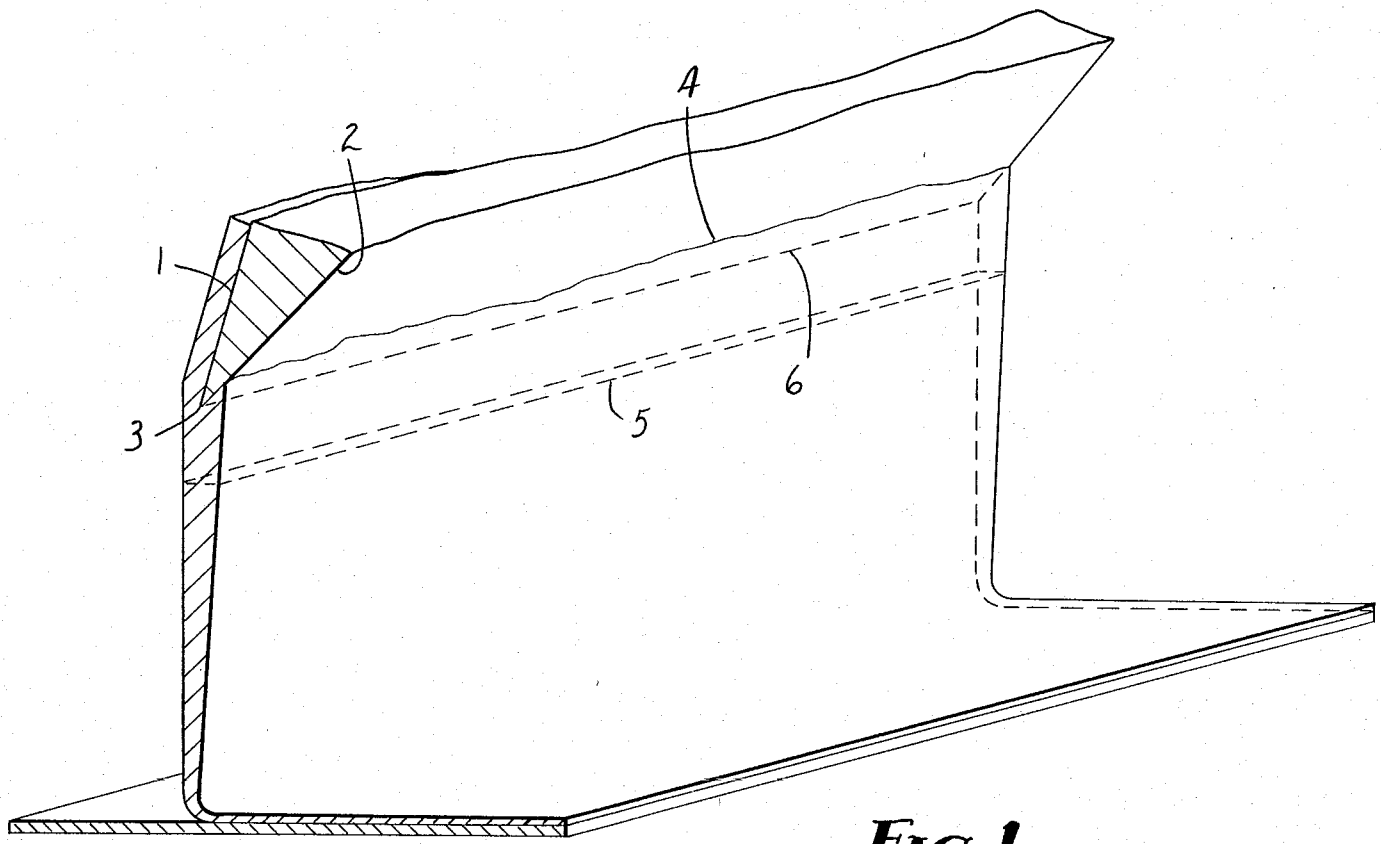
FIG. 1 PRIOR ART
FIG. 1 shows a section of a prior art lip in a curtain coater with extruded material being deposited on a surface.

The shape of the lip has been believed to be of some importance, but it has been found, according to the present invention, that the non-slide or back surface of the lip has an unexpected relevance to the coating quality of the curtain coated films.

To assist in an understanding of the present invention, each of such lip surfaces, as well as other hopper surfaces, will be hereinafter described with reference to the plane of the curtain. The front or slide side of the hopper is assumed to be positioned on the left of the observer.

The hopper surfaces are assumed to be part of planes determined by clockwise or anticlockwise rotation of surfaces within curtain planes with respect to the curtain plane itself. Positive angles will correspond to clockwise rotation, while negative angles will correspond to anticlockwise rotation. Positive surfaces will indicate surfaces the (rotation) angle of which is positive and negative surfaces will indicate surfaces the (rotation) angle of which is negative. As indicated, the front side of the hopper is assumed to be the one where surfaces are provided for the sliding of the emulsion (after parting from slots), while the back side of the hopper is assumed to be the one where no emulsion slide occurs (or is assumed not to occur).

The present invention refers to an improved coating apparatus for use in curtain coating including (1) a feeding body, (2) a slide body determining (3) a front surface for the sliding of the coating composition associated with it and (4) a lip body for the leaving of such composition from the apparatus along (5) a negative slide surface, the improvement consisting of having such negative slide surface associated with a negative non-slide surface of said lip body.

The present invention preferably refers to a coating apparatus as described above in which said negative slide surface of said lip includes a substantially horizontal final portion thereof (the portion from which the coating composition leaves the hopper to form the curtain) or having a negative angle comprised between 60° and 95°.

Particularly, the present invention refers to an improved coating apparatus as described above in which the slide surface of said slide body, located between the slot of said feeding body and said lip body, is positive (a vertical surface is assumed to be included within the definition of negative).

Still particularly the present invention refers to an improved coating apparatus as described above in which the slide surface of said slide body, located between the slot of said feeding body and said lip body, is negative (when the characteristics of the coating composition, such as viscosity, allow it to be used).

In another aspect, the present invention refers to a method for the curtain coating of liquid compositions using the above apparatus.

Of course, various apparatus can be made acording to the present invention which will meet the particular conditions and/or problems the expert has to face.

The curtain coating method can be applied in various fields and conditions. The characteristics of the coating composition may for example vary with reference to its viscosity, surface tension and wettability characteristics. The same composition can be coated at various feeding flows, curtain heights and speeds. In the field of photography, the coating circumstances may change within wide ranges (the viscosity, for example, is known to vary from 1 to 300 centipoises). The general effects of each single variable within the system is known in the art and experiments can be made and conditions chosen which meet specific requirements.

FIG. 1 describes a curtain as formed by a conventional hopper (not shown) having a conventional lip (shown). A positive lip slide surface (1) is combined with a back positive surface (2) with a substantially horizontal surface (3).

The curtain is shown to climb up on the back surface of the lip which is shown to be wet in a non-uniform way along the line indicated in (4). This line distinguishing the wet from the non-wet portion of the back lip surface, includes curves which affect upon the cross section of the curtain, indicated in (5), causing non-uniform thickness. The dotted line (6) indicates the line along which the curtain would leave the lip if no such climbing up on the back surface of the lip occurred. The surface comprised between such line (6) and such line (4) is the back surface on which the curtain climbs.

Figure 2:
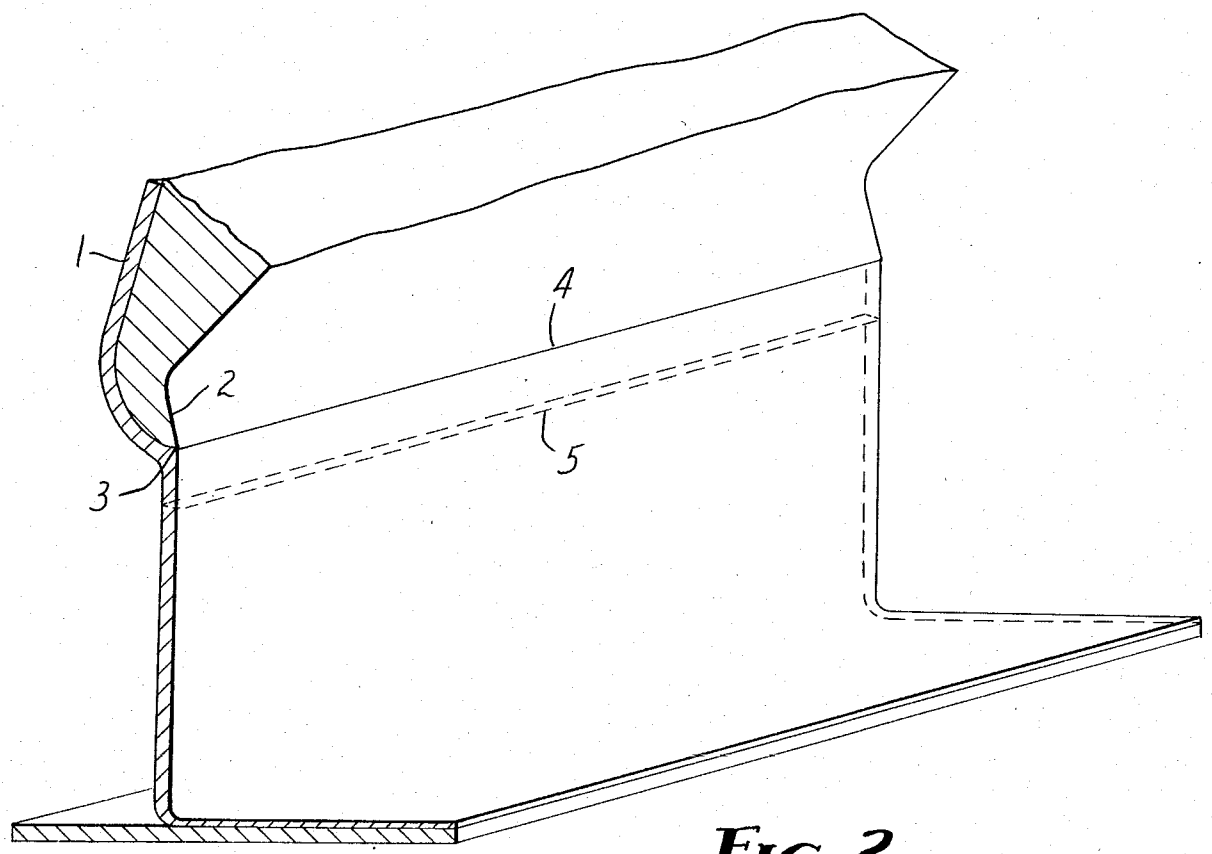
FIG. 2 shows a section of a curtain coater lip according to the present invention with extruded material being deposited on a surface.

FIG. 2 describes a curtain as obtained by a hopper (not shown in its conventional part including feeding and slide bodies) including the lip of the present invention. The coating composition is shown to not climb up on the back negative surface of the lip and to leave the lip along a straight wet-non wet line to form a curtain having uniform section and thickness.

The climbing of the curtain up on the back surface of the lip, as shown in FIG. 1, can be related to certain (wetting) characteristics of the photographic compositions which are normally added with wetting agents to improve their coatability on support bases. The absence, in FIG. 3, of such climbing up on the back surface of the lip by a curtain of the same composition (including the same wetting agents in the same amount) shows an improvement associated with the use of the lip of the present invention if compared with a lip of the prior art.

Figure 3:
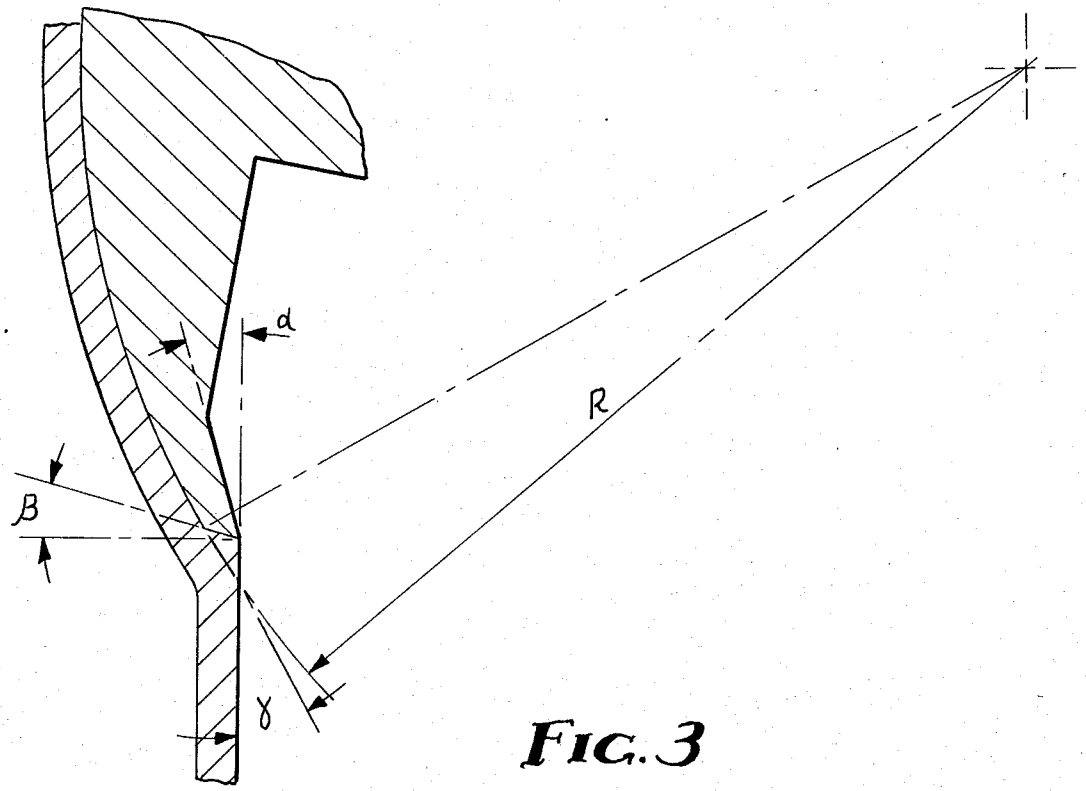
FIG. 3 shows a section of another embodiment of the curtain coater lip according to the present invention.

FIG. 3 shows, particularly, the extreme end of one lip made within the present invention. The shown example has R equal to 48 mm., $\alpha$ equal to 15°, $\beta$ equal to 15° and $\gamma$ equal to 40° (the drawing shows the apparatus on a 3 to 1 scale). The shown lip was used as part of a hopper having the slide portion thereof along a positive slide surface. The front surface of the lip body was made to meet such a positive surface along a portion of a circle starting positive (in the top part thereof) and ending negative (with the above $\gamma$ angle).

For the purposes of the present invention, it is essential, as indicated, that the back negative surface (described, for example, as angle $\alpha$ in FIG. 3) is associated with a front negative surface within the lip body (described, for example, as angle 90-$\beta$ in FIG. 3). The absolute value of $\alpha$, provided it is negative, vertical position included, is not believed to be critical to the present invention, even if reasons of convenience (concerning the construction of the lip) suggest an angle of less than 45°, preferably of less than 25°.

It is preferred that the surface front of said lip body is negative with an angle of substantially no more than 90°, more preferably comprised between 95° and 60°, most preferably between 90° and 70°.

It is also preferred that such a negative slide surface associated with such a back negative surface is associated with a second negative surface having a negative angle smaller (in its absolute value) than the angle of said (first) negative surface, preferably comprised between 15° and 55°, more preferably between 30° and 45°.

Accordingly, the front surface of the lip of the present invention does preferably include a first (or bottom) portion of negative surface where the curtain parts from the lip without climbing on its back and a second portion of negative surface associated with both said first parting portion and the slide surface portion of the hopper.

Such parting portion preferably has a length between 1 and 5 mm. and is more preferably of 1.5 to 3 mm.

The length of said second portion of the lip is less important, especially when it is associated with a negative slide surface of the hopper which may be substantially the same surface of said second portion of the lip. When it is associated with a slide positive surface, it may be convenient to have said second portion of the lip of a length of about 2 to 6 cm. Preferably, said second surface is provided by a portion of a circle to smoothly connect said first parting surface of the lip with the slide surface of the hopper, as shown in FIGS. 2 and 3.

One curtain coating apparatus (A) with a conventional lip (like the one described in FIG. 1), was compared with an apparatus (B), similar to (A), but having a lip of the present invention (the one described by FIG. 2 and, more precisely, by FIG. 3), to coat photographic compositions on a support base.

The support base was a normal subbed polyester base for use in radiography and the coating compositions were a gelatin silver halide coating composition and a gelatin protective coating composition like those described in U.S. Pat. No. 3,884,699. The coating conditions were those known in the art for speeds between 100 and 160 m/min.: curtain heights of 70 to 90 mm., flow between 60 and 70 cc/cm/min., static surface tension between 20 and 40 dine/cm. and viscosity between 9 and 45 centipoises. Samples of the obtained films were radiographically exposed and conventionally processed in X-ray automatic processors. While the film samples coated with apparatus (A) showed non-uniformity defects (zones of minor and major density along the coating direction), the film samples coated with apparatus (B) were free of such defects. Similar results were obtained on a color photographic paper obtained with conventional coating compositions.

What is claimed is:

1. An improved coating apparatus for use in curtain coating including a feeding body, a slide body determining a front surface for the sliding of the coating composition associated with it and a lip body where such composition leaves the apparatus along a negative slide surface, the improvement consisting of having such negative slide surface associated with a negative non-slide surface of said lip body.

2. The coating apparatus of claim 1, wherein such slide surface of said lip body is negative with an angle of substantially no more than 90°.

3. The coating apparatus of claim 2, wherein said negative slide surface of said lip body is combined with a negative surface determined by said slide body.

4. The coating apparatus of claim 2, wherein said negative slide surface of said lip body is combined with a positive slide surface determined by said slide body.

5. The coating apparatus of claim 4, wherein said negative slide surface of said lip body is further associated with a second negative surface with a negative angle smaller than said first negative angle.

6. The coating apparatus of claim 5, wherein said first negative surface has an angle of 95° to 60° and is associated with a second negative surface having an angle of 15° to 55°.

7. A coating apparatus of claim 6 in which said first surface is from 1 to 5 mm long.

* * * * *